US008646363B2

(12) United States Patent
Yang et al.

(10) Patent No.: US 8,646,363 B2
(45) Date of Patent: Feb. 11, 2014

(54) RATCHET WITH COATED LAYER AND THE METHOD FOR MAKING THE SAME

(76) Inventors: Cheng-Pu Yang, Changhua (TW); Sen-Yuan Hou, Changhua County (TW)

( * ) Notice: Subject to any disclaimer, the term of this patent is extended or adjusted under 35 U.S.C. 154(b) by 273 days.

(21) Appl. No.: 13/301,765

(22) Filed: Nov. 21, 2011

(65) Prior Publication Data

US 2013/0125713 A1 May 23, 2013

(51) Int. Cl.
*B25B 13/46* (2006.01)
*C25D 7/00* (2006.01)

(52) U.S. Cl.
USPC ..... 81/60; 205/122

(58) Field of Classification Search
USPC ..... 81/60; 76/114; 205/122, 136
See application file for complete search history.

(56) References Cited

U.S. PATENT DOCUMENTS

| | | | | |
|---|---|---|---|---|
| 6,082,227 | A * | 7/2000 | Vogel | 81/119 |
| 6,701,768 | B2 * | 3/2004 | Ling et al. | 72/356 |
| 7,028,588 | B2 * | 4/2006 | Shih | 81/121.1 |
| 2007/0151423 | A1 * | 7/2007 | Wu | 81/63.1 |
| 2010/0180659 | A1 * | 7/2010 | Lin | 72/367.1 |

* cited by examiner

*Primary Examiner* — David B Thomas

(57) ABSTRACT

A ratchet includes multiple ratchet teeth defined in the outer periphery thereof and a coated layer is coated along the outer periphery of the ratchet. A laser device is used to generate a laser beam to remove a part of the coated layer to defined openings in the coated layer and the ratchet teeth protrude from the openings.

14 Claims, 7 Drawing Sheets

RATCHET WITH COATED LAYER AND THE METHOD FOR MAKING THE SAME

FIELD OF THE INVENTION

The present invention relates to a ratchet, and more particularly, to a ratchet with a coated layer to be more distinguishable and increase aesthetic features.

BACKGROUND OF THE INVENTION

Some of the conventional hand tools such as wrenches and sockets have a layer coated on the outer surface thereof for the aesthetic purposes and are disclosed in U.S. Pat. Nos. 6,082,227 and 7,028,588. The conventional ways to coat the layer include dying, Nickel electro-coating, Chromium electro-coating, Titanium electro-coating, Tin electro-coating, color electro-coating, painting, coloring and other known methods so as to improve the outer appearances of the tools and the size data can be seen from the coated layer.

The size of the tools is fixed so that the manufacturers often do not put the coated layer in consideration, especially that the coated layer does not affect the operation of the tools. However, the coated layer can be up to 0.5 mm which may affect the operation of ratchets. As shown in FIGS. 12 to 14, the ratchet 50 has a coated layer 60 coated thereon and the surfaces 51 of the ratchet teeth 500 are also coated with the coated layer 60 so that the height of the teeth 500 is increased and the gap 52 between the teeth 500 is reduced. The surface 61 of the coated layer 60 is not strong when the teeth 500 are operated so that the torque transmitted by the ratchet 50 is reduced. When the ratchet teeth 500 are engaged with a pawl, the depth that the teeth 500 are engaged with the pawl is reduced and the torque transmitted is reduced. If the ratchet is larger than 19 mm, the height from the bottom of the teeth to the tip of the teeth is 0.58 mm and the thickness of the coated layer 60 is 0.5 mm so that only a limited portion of the teeth is remained. The torque is reduced slightly. However, if the ratchet is a smaller one such as 8 mm ratchet, the height from the bottom of the teeth to the tip of the teeth is 0.28 mm and the thickness of the coated layer 60 is 0.5 mm so that there will be no teeth left and the engagement between teeth is failed, the lost of torque is significant. This is especially obvious for the ratchets of 8 mm to 15 mm.

The present invention intends to provide a ratchet with a coated layer which improves the outer appearance and provides more distinguishable feature, while the shape of the ratchet teeth is maintained.

SUMMARY OF THE INVENTION

The present invention relates to a ratchet and comprises multiple ratchet teeth defined in the outer periphery thereof and a coated layer is coated along the outer periphery of the ratchet. A laser device is used to generate a laser beam to remove a part of the coated layer to defined openings in the coated layer and the ratchet teeth protrude from the openings.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
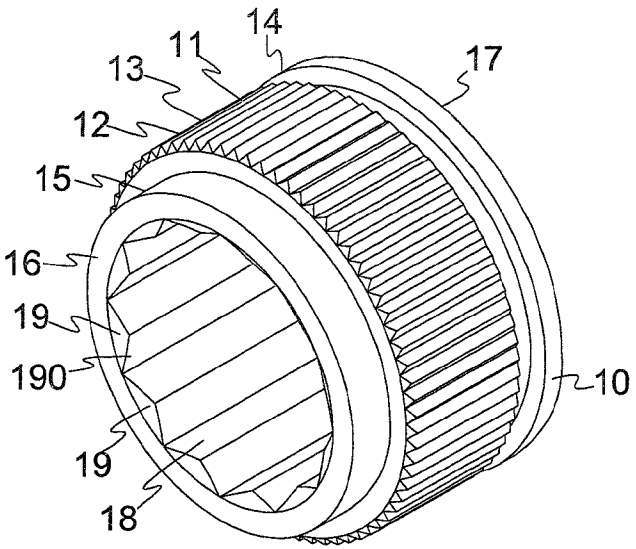
FIG. 1 is a perspective view to show the ratchet of the present invention.
Figure 5:
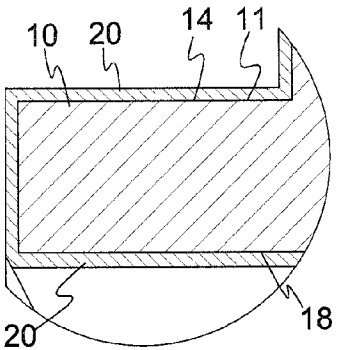
FIG. 5 is an enlarged view of the circled portion in FIG. 4.
Figure 4:
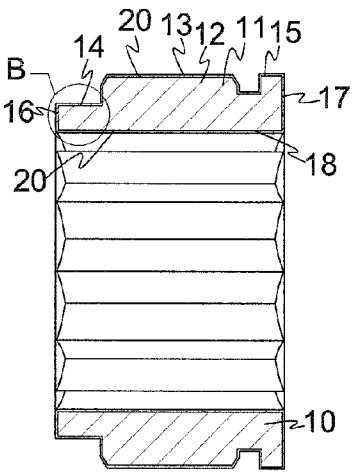
FIG. 4 is a cross sectional view, taken along line A-A in FIG. 3.
Figure 3:
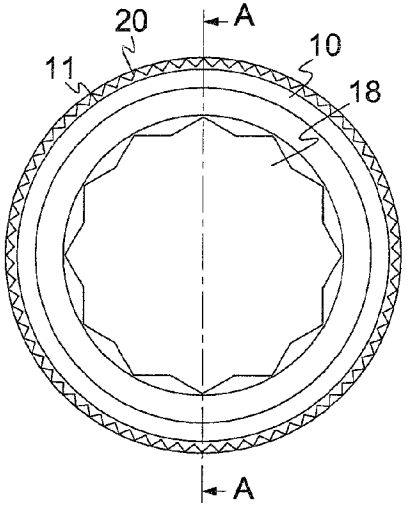
FIG. 3 is an end view to show the ratchet of the present invention, wherein the coated layer is coated to the ratchet.
Figure 9:
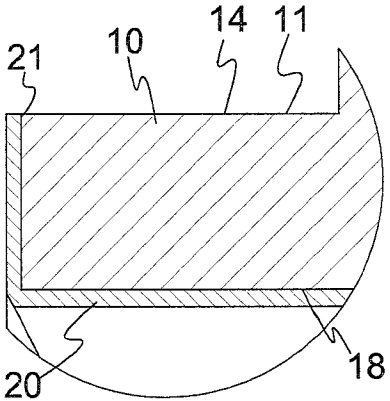
FIG. 9 is an enlarged view of the circled portion in FIG. 8.
Figure 8:
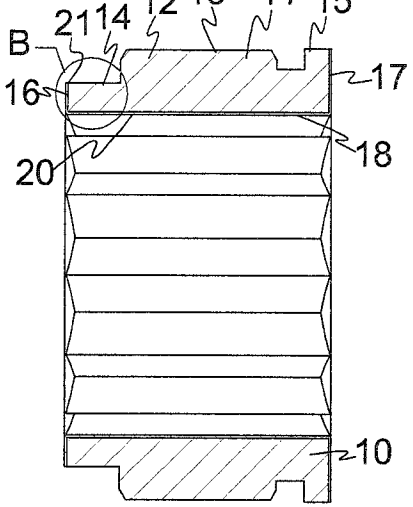
FIG. 8 shows that the coated layer on the ratchet is partly removed, the remained layer is existed on the inner periphery and the end faces.

Referring to FIGS. 8 and 9, the ratchet 10 of the present invention comprises multiple ratchet teeth 12 defined in the outer periphery 11 thereof so as to be located in the ratchet mechanism of a wrench to have one-way driving function. A coated layer 20 is coated to the outer periphery of the ratchet 10 and has openings 21 defined therethrough and the ratchet teeth 12 protrude from the openings 21. In the drawings, the ratchet 10 is a ring-shaped member and has an outer periphery 11 and an inner periphery 18, the inner periphery 18 is coated with the coated layer 20. Multiple engaging ridges 19 extend from the inner periphery 18 of the ratchet 10 and are hold an object such as a nut or a bolt head. As shown in FIG. 1, eighteen recesses 190 are defined between the engaging ridges 19. The recesses 190 are consecutive and each are a V-shaped recess. The inner periphery has at least 1 mm tolerance in the Deutsch Industrial Normen (DIN), so that when the coated layer 20 of 0.5 mm is coated, the object can be engaged with the inner periphery 18 so that the coated layer 20 at the inner periphery 18 does not need to be removed.

Figure 11:
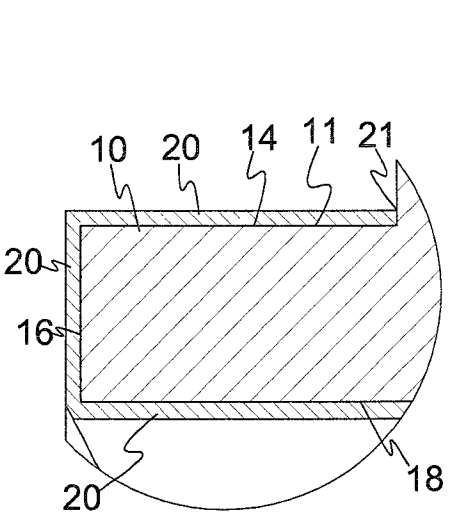
FIG. 11 is an enlarged view of the circled portion in FIG. 10.
Figure 10:
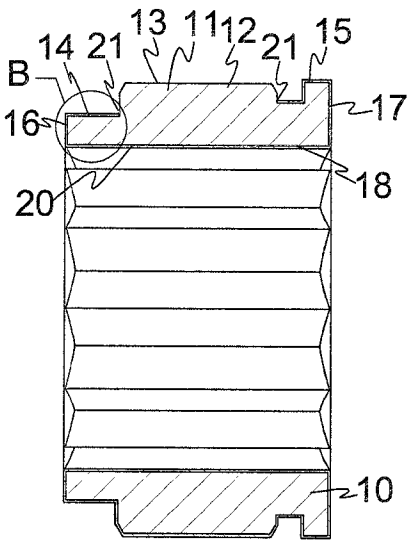
FIG. 10 shows that the coated layer on the middle section of the outer periphery of the ratchet is partly removed, the remained layer is existed on the end sections of the inner periphery and the end faces.
Figure 13:
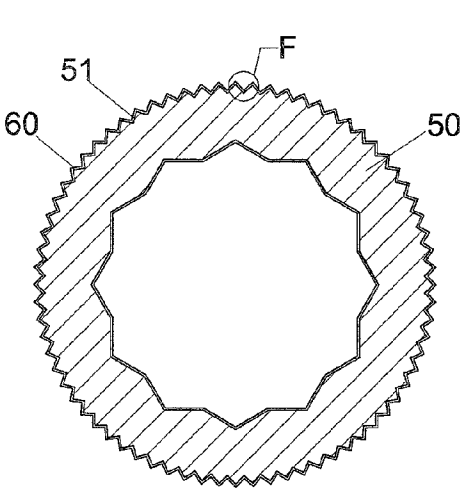
Prior Art FIG.13
FIG. 13 is a cross sectional view, taken along line E-E in FIG. 12.
Figure 12:
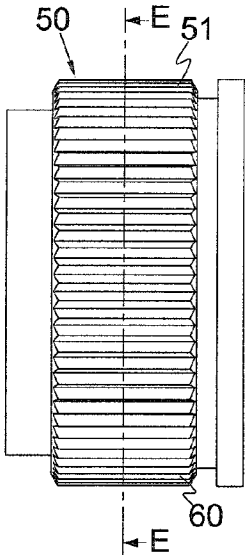
Prior Art FIG.12
FIG. 12 is a side view of the conventional ratchet.
Figure 14:
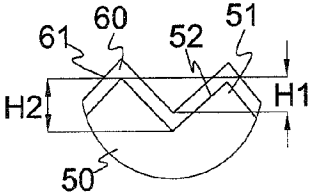
Prior Art FIG.14
FIG. 14 is an enlarged view of the circled portion in FIG. 13.

As shown in FIGS. 10 and 11, the ratchet 10 has a middle section 13 and two end sections 14, 15 located along the outer periphery 11 and the middle section 13 is located between the two end sections 14, 15 The ratchet teeth 12 are located at the middle section 13 and the two end sections 14, 15 are coated with the coated layer 20.

Figure 2:
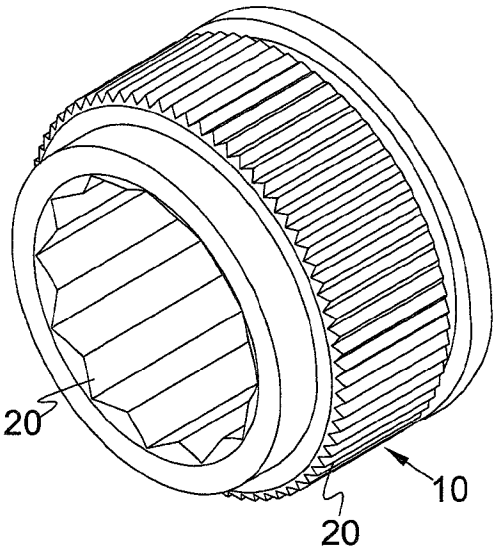
FIG. 2 is a perspective view to show the ratchet of the present invention, wherein the coated layer is coated to the ratchet.

As shown in FIG. 1, the ratchet 10 is made first. As shown in FIG. 2, the ratchet 10 is processed by dying, Nickel electro-coating, Chromium electro-coating, Titanium electro-coating, Tin electro-coating, color electro-coating, painting, coloring and other known methods during the manufacturing of the ratchet 10 or after the ratchet 10 is made. The coated layer 20 is coated to all of the surfaces of the ratchet 10. As shown in FIGS. 2 to 5, the ratchet 10 is a ring-shaped member, and the coated layer 20 is coated to the outer periphery 11, the two ends faces 16, 17 and the inner periphery 12. The inner periphery 18 of the ratchet 10 is shaped to be matched with a rod 30. The rod 30 has one end connected with a nut 33 which restricts the ratchets 10 from dropping from the rod 30. As shown in FIGS. 7 to 10, a laser device 40 is used to generate a laser beam which moves along the rod 30 longitudinally back and forth, while the rod 30 and the ratchets 10 on the rod 30 are rotated at fixed speed, to remove the part of the coated layer 20 on the outer periphery 11 to define the openings 21. The laser beam is restricted to be within a fixed range of temperature and keeps at a distance from the ratchets 10 to avoid from damaging the ratchets 10.

Figure 6:
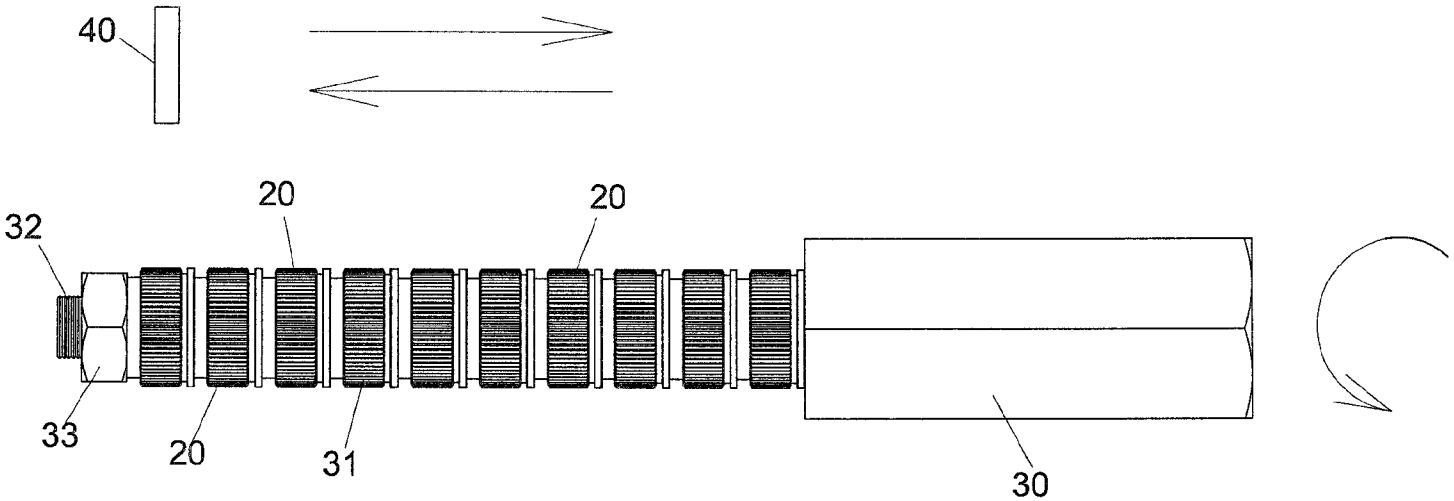
FIG. 6 shows that the ratchets of the present invention are mounted to the rod.
Figure 7:
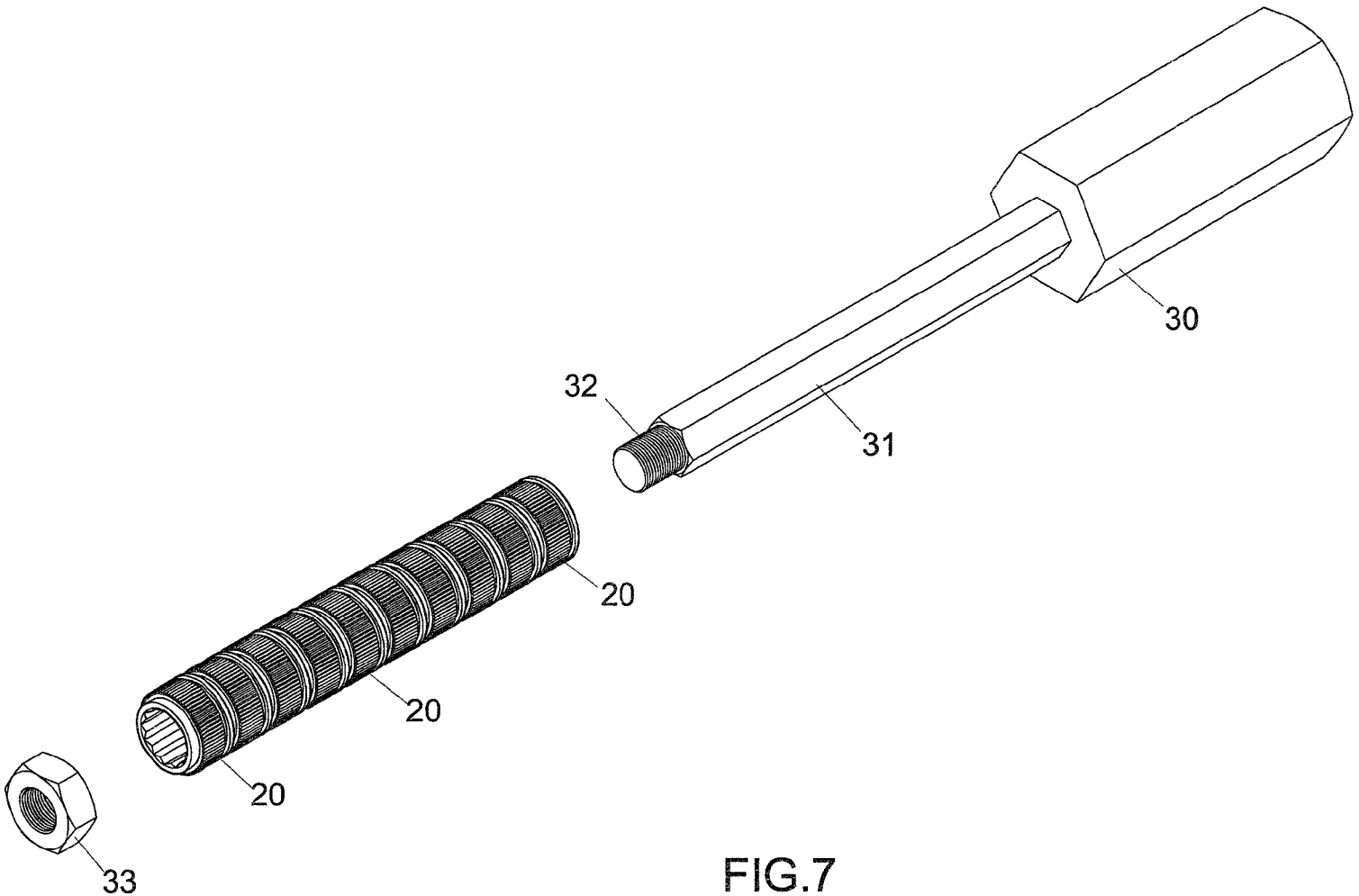
FIG. 7 shows that a part of the coated layer is removed by using a laser device.

As shown in FIG. 6, the ratchets 10 of the present invention may include different sizes (5 mm to 32 mm) and the rods 30 may have the middle section 31 of different sizes so that the ratchets 10 of different sizes can be mounted to the middle sections 31.

The coated layer 20 on the ratchets 10 improves the aesthetic appearance thereof and the ratchets 10 are more distinguishable. The coated layer 20 on the ratchets 10 have openings 21 for the ratchet teeth 12 to be exposed therefrom and this maintain the engagement ability and the torque transmitted is not affected. The ratchets 10 are ring-shaped members and the coated layer 20 on the inner periphery shows the characters that the coated layer 20 is supposed to be.

While we have shown and described the embodiment in accordance with the present invention, it should be clear to those skilled in the art that further embodiments may be made without departing from the scope of the present invention.

What is claimed is:

1. A method for making a ratchet with a coated layer, comprising:

step a: providing at least one ratchet and multiple ratchet teeth defined in an outer periphery of the at least one ratchet;

step b: coating a coated layer along the outer periphery of the at least one ratchet, and step c: using a laser device to generate a laser beam to remove a part of the coated layer to defined openings in the coated layer and the ratchet teeth protruding from the openings.

2. The method as claimed in claim 1, wherein there are multiple ratchets and each ratchet is a ring-shaped member, an inner periphery of each of the ratchets is shaped to be matched with a rod, in the step c, the multiple ratchets are mounted to the rod which rotates at a fixed speed, the laser beam moves along the rod longitudinally back and forth to remove the part of the coated layer to define the openings.

3. The method as claimed in claim 2, wherein the rod has one end connected with a nut which restricts the ratchets from dropping from the rod.

4. The method as claimed in claim 1, wherein the coated layer in the step b is a metal layer which is electro-coated to the at least one ratchet.

5. The method as claimed in claim 4, wherein the metal layer comprises at least one of Nickel, Chromium, Titanium and Tin.

6. The method as claimed in claim 1, wherein the coated layer in the step b is a metal layer which is color electro-coated to the at least one ratchet.

7. A ratchet comprising:

multiple ratchet teeth defined in an outer periphery of the ratchet and a coated layer being coated to an outer periphery of the ratchet, the coated layer having openings and the ratchet teeth protruding from the openings.

8. The ratchet as claimed in claim 7, wherein the ratchet has a middle section and two end sections along the outer periphery and the middle section and the two end sections are located along an axis of the ratchet, the middle section is located between the two end sections, the ratchet teeth are located at the middle section and the two end sections are coated with the coated layer.

9. The ratchet as claimed in claim 7, wherein two end faces of the ratchet are coated with the coated layer.

10. The ratchet as claimed in claim 7, wherein the ratchet is a ring-shaped member and has an outer periphery and an inner periphery, the inner periphery is coated with the coated layer.

11. The ratchet as claimed in claim 10, wherein multiple engaging ridges extend from the inner periphery of the ratchet and are adapted to hold an object.

12. The ratchet as claimed in claim 11, wherein multiple recesses are defined between the engaging ridges.

13. The ratchet as claimed in claim 12, wherein the multiple recesses are consecutive and each are a V-shaped recess.

14. The ratchet as claimed in claim 10, wherein the ratchet has a middle section and two end sections along the outer periphery thereof and the middle section and the two end sections are located along an axis of the ratchet, the middle section is located between the two end sections, the ratchet teeth are located at the middle section and the two end sections are coated with the coated layer.

* * * * *